US006941911B2

(12) United States Patent
Reichert

(10) Patent No.: US 6,941,911 B2
(45) Date of Patent: Sep. 13, 2005

(54) ADJUSTABLE VALVE CONTROL DEVICE FOR AN INTERNAL COMBUSTION ENGINE

(75) Inventor: Hans-Joachim Reichert, Schefflenz (DE)

(73) Assignee: Audi AG (DE)

( * ) Notice: Subject to any disclaimer, the term of this patent is extended or adjusted under 35 U.S.C. 154(b) by 0 days.

(21) Appl. No.: 10/398,475

(22) PCT Filed: Sep. 29, 2001

(86) PCT No.: PCT/EP01/11298

§ 371 (c)(1),
(2), (4) Date: Sep. 8, 2003

(87) PCT Pub. No.: WO02/31322

PCT Pub. Date: Apr. 18, 2002

(65) Prior Publication Data

US 2004/0025821 A1 Feb. 12, 2004

(30) Foreign Application Priority Data

Oct. 6, 2000 (DE) ..... 100 49 494

(51) Int. Cl.[7] ..... F01L 1/34

(52) U.S. Cl. ..... 123/90.17; 123/90.15; 123/90.16; 123/90.18

(58) Field of Search ..... 123/90.15–90.18, 123/90.12, 90.31; 74/568 R; 464/1, 2, 160; 92/121, 122

(56) References Cited

U.S. PATENT DOCUMENTS

| | | | | |
|---|---|---|---|---|
| 6,170,448 | B1 * | 1/2001 | Asakura | 123/90.18 |
| 6,173,687 | B1 * | 1/2001 | Fukuhara et al. | 123/90.17 |
| 6,230,675 | B1 | 5/2001 | Kobayashi et al. | 123/90.15 |
| 6,390,044 | B2 * | 5/2002 | Yoshizawa et al. | 123/90.17 |

FOREIGN PATENT DOCUMENTS

| | | | |
|---|---|---|---|
| DE | 199 03 594 A1 | 8/1999 | F01L/1/344 |
| DE | 199 43 833 A1 | 3/2001 | F01L/1/344 |
| EP | 0 857 859 A1 | 8/1998 | F01L/1/344 |
| JP | 09250312 | 9/1997 | F01L/1/34 |

* cited by examiner

*Primary Examiner*—Thomas Denion
*Assistant Examiner*—Jaime Corrigan
(74) *Attorney, Agent, or Firm*—Stevens, Davis, Miller & Mosher, LLP

(57) ABSTRACT

An adjustable valve control device for an internal combustion engine with a drive shaft, with a camshaft 1 rotated by the drive shaft, and with at least one valve actuated by the camshaft 1 with a specific timing. The valve control device modifies the rotary phase of the camshaft 1 relative to the drive shaft in order to modify the timing of at least one valve and comprises a first rotor 2 which rotates synchronously with the drive shaft, a second rotor 3 which rotates synchronously with the camshaft 1, and a lock bolt 14 for locking the first rotor 2 and the second rotor 3 relative to each other. Fluid is applied to the lock bolt 14 by way of a separate line 15 to lock the rotors and is removed to unlock the rotors.

8 Claims, 3 Drawing Sheets

ADJUSTABLE VALVE CONTROL DEVICE FOR AN INTERNAL COMBUSTION ENGINE

FIELD OF THE INVENTION

This invention relates to a valve control device for an internal combustion engine having a drive shaft, a camshaft rotated by the drive shaft, and at least one valve actuated by the camshaft for specific timing, the valve control device modifying the rotary plane of the camshaft relative to the drive shaft in order to modify the timing of at least one valve, comprising a first rotor which rotates synchronously with the drive shaft, comprising a second rotor which rotates synchronously with the camshaft, a number of fluid pressure chambers being formed between the first rotor and the second rotor, which are supplied with fluid over at least one line of a fluid system equipped with a return valve, so that the rotary phase of the camshaft relative to that of the drive shaft is modified by rotation of the first rotor in the direction opposite that of the second rotor, and comprising a lock bolt for locking the first rotor and the second rotor relative to each other.

The lock bolt is required in an adjustable valve control device such as this in order to secure the valve timing when the internal combustion engine is started until the chambers are completely filled and a specific fluid or oil pressure has been built up, this pressure then assuming the function of supporting the camshaft torque values and adjustment of the valve timing. In addition, the lock bolt prevents the occurrence of undesirable noise when the valve control device is idling. The lock bolt also serves the purpose of ensuring the so-called quick-start in which the ignition sparks are triggered on the camshaft by a hall screen on the camshaft. It is important for the startup behavior of the internal combustion engine especially in the event of large adjustment ranges that the control device be held in the low-overlap position of intake and outlet when the fluid pressure chambers are empty.

BACKGROUND OF THE INVENTION

A generic valve control device is disclosed in publication DE 199 03 594 A1. In the valve control device illustrated in this publication the fluid is applied to both sides of the second rotor in the form of an impeller rotor with fluid pressure chambers, so that the lock bolt may be removed from the lock opening and released free of subjection to transverse forces, independently of the particular fluid pressure chamber which is pressurized at any given time. Inherent in this valve control device, however, is the disadvantage that repeated insertion into the lock opening and locking of the lock bolt cannot be ensured. When the internal combustion engine is shut off residual torque acts on the camshaft, so that the fluid pressure cannot drop on the side supporting the impeller rotor. As a result of leaks the impeller rotor is then rotated from its locking position, so that the lock bolt may not be inserted into the lock opening and effect locking.

Also of the state of the art is application to the lock bolt of fluid or oil from only one side of the first rotor in the form of an impeller rotor, so that the locking conditions for the lock bolt are always clearly indicated. The problem arises here, however, that the lock bolt may be removed from the lock opening and effect locking only if sufficient pressure has been built up on the respective side. But this has the result that the lock bolt may not be removed from the lock opening and effect release free of subjection to transverse forces; in the event of delayed release this may lead to a tendency to jam and to high wear of the locking system.

On the basis of this state of the art the object of the present invention is to provide an improved adjustable valve control device which makes certain that the lock bolt is locked and unlocked at the proper time, that is, that it is fully inserted and locked when the internal combustion engine is started and later unlocked when the oil pressure has been fully built up in the cylinder head, independently of the pressure relationships in the fluid pressure chamber.

SUMMARY OF THE INVENTION

This object is attained by an adjustable valve control device having the features specified in the claims. In that fluid may be applied to the lock bolt by way of a separate line which branches off upstream from the return valve of the fluid system, maintenance for an extended period of time of a residual pressure which is disruptive during locking and unlocking when the internal combustion engine is switched off depending on the adjustment of the camshaft or time following leaks is prevented. It is claimed for the invention that the lock bolt no loner depends on the pressure in the fluid pressure chambers of the impeller rotor but only on the pressure in the separate line of the fluid system.

It is advisable for the first rotor and the second rotor of the valve control device to be secured on end to the camshaft by means of a fastening element coaxial with the camshaft. The fastening element is generally a screw the threaded portion of which operates in conjunction with a coaxial threaded opening in the camshaft. The fastening element forms only a bearing for the first rotor and the second rotor.

In one particular embodiment of the invention the separate line for the lock bolt is guided so that this line extends from the fluid system to a channel through the center of the camshaft and from this point along a cavity in the fastening element coaxial with the camshaft and through the second rotor to a pressure chamber for the lock bolt. In this way the mounting of the separate line can be especially favorable and space-saving, since no costly rotary passage such as is already provided for the minimum of one line of the fluid system is required.

In a development of this particular embodiment for fastening element coaxial with the camshaft bears a ringshaped seal which seals the first line, which extends to the fluid pressure chambers by way of an annular space between the fastening element coaxial with the camshaft and the second rotor, from the separate line which extends through a separate channel in the second rotor for the lock bolt. It may be necessary to offset and/or shorten the annular space somewhat axially in order to provide space for the seal and the fluid connection of the cavity in the fastening element of the second rotor coaxial with the camshaft.

It is advantageous for the lock bolt to be designed as a stepped bolt. As a result, the fluid for unlocking the lock bolt no longer needs to be conducted by way of the first rotor. The lock bolt may, of course, also be in the form of a simple bolt.

It is especially advantageous for the pressure chamber for the lock bolt to open directly into the atmosphere.

BRIEF DESCRIPTION OF THE DRAWINGS

This invention is discussed in detail in what follows with reference to the figures of the drawing, of which

DETAILED DESCRIPTION OF THE INVENTION

Figure 1:
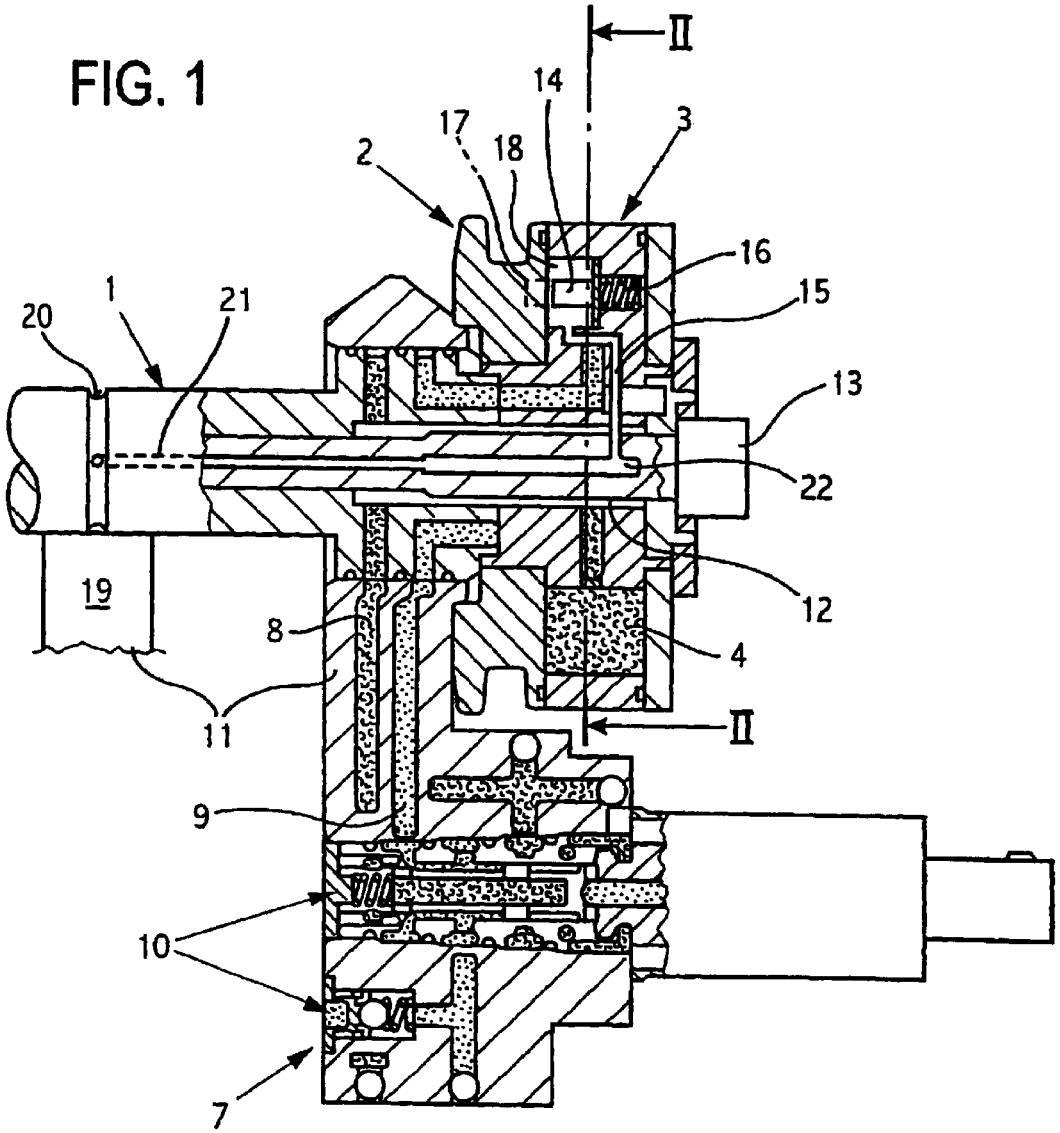
FIG. 1 presents a simplified sectional view of a valve control device.
Figure 2:
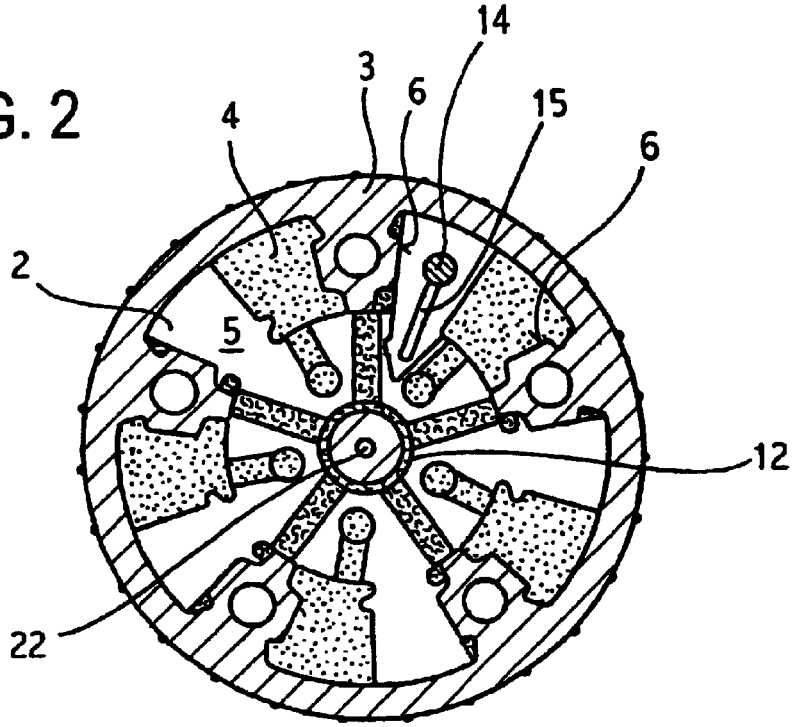
FIG. 2 a section along line II—II of the valve control device shown in FIG. 1, with the valve timing set for "early"
Figure 4:
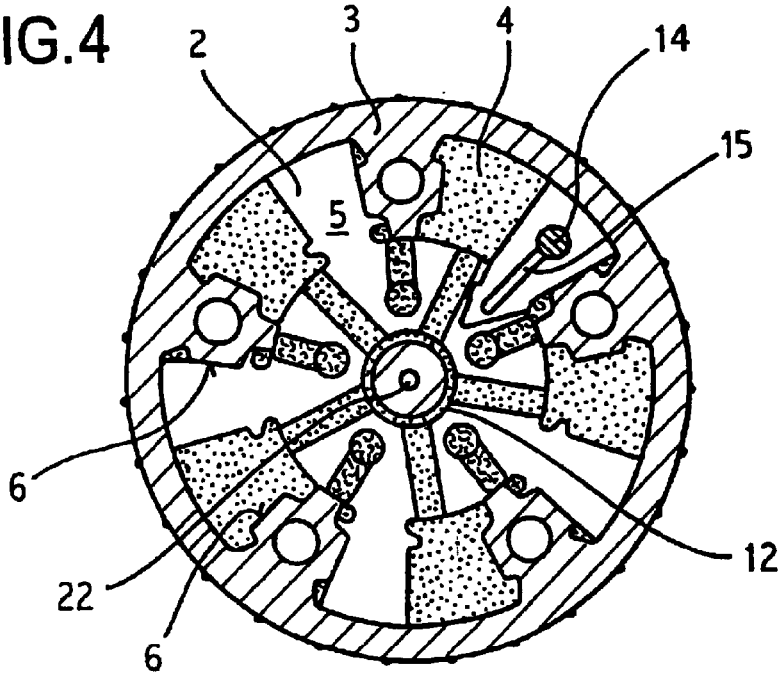
FIG. 4 a section along line IV—IV of the valve control device shown in FIG. 3, with the valve timing set for "late."
Figure 3:
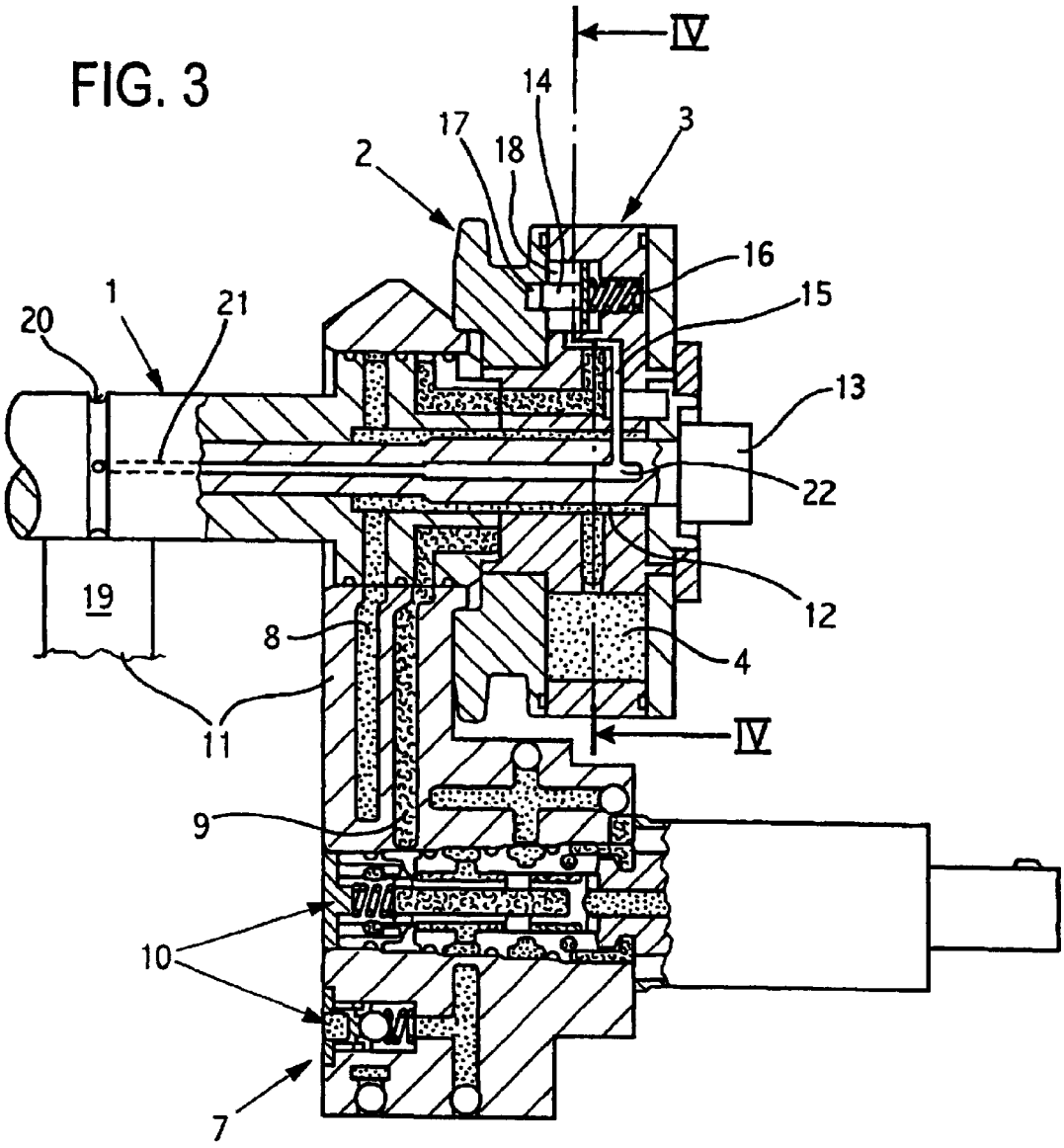
FIG. 3 a simplified sectional view of the valve control device.

The valve control device as claimed in the invention adjusts, for example, the timing of the intake valves of an internal combustion engine by modifying the rotary phase of the camshaft relative to the drive shaft.

For this purpose the valve control device is mounted on end on the crankshaft 1 of the internal combustion engine and has a first rotor 2 and a second rotor 3.

The first rotor 2 is rotatably mounted on the camshaft 1 of the internal combustion engine, is in the form of an impeller rotor, and has a belt pulley or sprocket wheel which is connected by way of a belt or chain to the drive shaft, not shown, of the internal combustion engine, so that the first rotor 2 rotates synchronously with the drive shaft.

The second rotor 3 is in the form of a kind of bucket wheel which is rigidly mounted on the camshaft 1 and accordingly rotates synchronously with the camshaft 1.

A plurality of fluid pressure chambers 4 are formed between the first rotor 2 and the second rotor 3 or respectively between the impeller rotor and the bucket wheel, it being possible to move the first rotor 2 from its first position, in which its impeller 5 always rests against the left walls 6 of the bucket wheel of the second rotor 3, to a second position, in which its impeller 5 always rests against the right walls 6 of the bucket wheel. "Early" valve timing is set for the period of the first position, but "late" valve timing for the period of the second position. The valve control device is continuously adjustable over this range.

The fluid pressure chambers 4 are supplied with fluid or oil made available by way of a fluid system 7 from both sides of the impellers 5 of the first rotor 2. The fluid system 7 has, among other things, a first line 8 and a second line 9, associated with each of which is a return valve 10.

The fluid pressure chambers 4 are supplied from one side with fluid by way of the first line 8, which is guided by way of the front wall of the cylinder head 11, an annular space 12 between a fastening element 13 coaxial with the camshaft 1, and through the second rotor 3. From the other side of the fluid pressure chambers 4 are supplied with fluid by way of a second line 9, which also is guided by way of the front wall of the cylinder head 11 to the camshaft 1 and from the front wall of the camshaft 1 by way of the second rotor 3.

A lock bolt 14 positioned in the second rotor 3 which may be inserted into and withdrawn from a lock opening 17 in the first rotor 2 and effect locking and unlocking, as a function of the pressure in a separate third line 15 and the force of a spring 16, is provided for locking the first rotor 2 and the second rotor 3 relative to each other. If the lock bolt 14 is designed as a stepped bolt, the fluid for unlocking must not be conducted by way of the first rotor 2. The pressure chamber 18 for the lock bolt 14 for the sake of simplicity opens directly into the atmosphere.

The third line 15 leads from the fluid system 7 upstream from the return valves 10 to the proximate bearing point 19 for the camshaft 1, from the bearing point 19 by way of a circular groove 20 in the camshaft 1 to channel 21 through the center of the camshaft 1, and from there extends along a cavity 22 in the fastening element 13 coaxial with the camshaft 1 and through the second rotor 3 to the pressure chamber 18 for the lock bolt.

Consequently, during startup of the internal combustion engine, that is, when the fluid system 7 is in a virtually pressure-free state, the lock bolt 14 may be inserted into and withdrawn from its lock opening 17 without problems, provided it has not remained in this normal position when the internal combustion engine was switched off. Over the period in which pressure is applied to the fluid system 7 the lock bolt 14 may be withdrawn from the lock opening 17 and effect unlocking free of transverse forces against the force of the spring 16. And even when the internal combustion engine is switched off and restarted, the lock bolt 14 may be inserted into the corresponding lock opening 17 and effect locking again without problems, since the pressure in the third line 15 may drop more rapidly when the internal combustion engine is shutoff without a return valve and because of a larger number of leaks, than in the first and second lines 8, 9 of the fluid system 7. This presents the additional advantage that the lock bolt 14 does not effect unlocking until the complete fluid system 7, that is, the fluid pressure chambers and the oil channels in the cylinder head, are completely filled with oil, since only at that time has appreciable pressure been built up.

What is claimed is:

1. An adjustable valve control device for an internal combustion engine having a drive shaft, a camshaft rotated by the crankshaft, and at least one valve actuated by the camshaft with a specific timing, the valve control device modifying a rotary phase of the camshaft relative to the drive shaft in order to change the timing of at least one valve, comprising a first rotor which rotates synchronously with the drive shaft, a second rotor which rotates synchronously with the camshaft, there being formed between the first rotor and the second rotor a plurality of fluid pressure chambers which are supplied with fluid by way of at least one line provided with a return valve, so that the rotary phase of the camshaft relative to the drive shaft may be modified by rotation of the first rotor in a direction opposite that of the second rotor, and a lock bolt for locking the first rotor and the second rotor from each other, characterized in that fluid is applied to the lock bolt by way of a separate line which branches off upstream from the return valve.

2. The valve control device as claimed in claim 1, wherein the first rotor and the second rotor are secured on end to the camshaft by means of a fastening element coaxial with the camshaft.

3. The valve control device as claimed in claim 2, wherein the separate line extends from a fluid system to a bearing point of the camshaft by way of a circulatory groove to a channel through the center of the camshaft and from there along a cavity in the fastening element coaxial with the camshaft and through the second rotor to a pressure chamber for the lock bolt.

4. The valve control device as claimed in claim 1, wherein there is mounted on the fastening element coaxial with the camshaft a ringshaped seal which seals a first line, which extends between the fastening element coaxial with the camshaft by way of a ringshaped space and the second rotor to the fluid pressure chambers, from the separate line, which extends by way of a channel in the second rotor to the pressure chamber for the lock bolt.

5. The valve control device as claimed in claim 4, wherein the lock bolt is designed as a stepped bolt.

6. The valve control device as claimed in claim 5, wherein the pressure chamber for the lock bolt opens into the atmosphere.

7. The valve control device as claimed in claim 3, wherein the pressure chamber for the lock bolt opens into the atmosphere.

8. The valve control device as claimed in claim 1, wherein the lock bolt is designed as a stepped bolt.

* * * * *